US012416146B2

(12) United States Patent
Nelson

(10) Patent No.: US 12,416,146 B2
(45) Date of Patent: Sep. 16, 2025

(54) VENTILATED TOILET

(71) Applicant: David Nelson, North Vancouver (CA)

(72) Inventor: David Nelson, North Vancouver (CA)

(73) Assignee: David Nelson, North Vancouver (CA)

( * ) Notice: Subject to any disclaimer, the term of this patent is extended or adjusted under 35 U.S.C. 154(b) by 113 days.

(21) Appl. No.: 18/519,663

(22) Filed: Nov. 27, 2023

(65) Prior Publication Data

US 2024/0093475 A1 Mar. 21, 2024

Related U.S. Application Data

(63) Continuation-in-part of application No. 17/503,669, filed on Oct. 18, 2021, now abandoned, which is a continuation of application No. 16/381,782, filed on Apr. 11, 2019, now Pat. No. 11,149,425.

(60) Provisional application No. 62/656,547, filed on Apr. 12, 2018.

(51) Int. Cl.
*E03D 9/052* (2006.01)

(52) U.S. Cl.
CPC ..... *E03D 9/052* (2013.01)

(58) Field of Classification Search
CPC ..... E03D 9/052
USPC ..... 4/347–349
See application file for complete search history.

(56) References Cited

U.S. PATENT DOCUMENTS 4,388,737 A * 6/1983 Wenzel ..... E03D 1/142 4/364
4,989,276 A * 2/1991 Martens ..... E03D 9/052 4/349
11,149,425 B2 * 10/2021 Nelson ..... E03D 9/052
2013/0086736 A1 * 4/2013 Larouche ..... E03D 9/052 4/348

* cited by examiner

*Primary Examiner* — Tuan N Nguyen
(74) *Attorney, Agent, or Firm* — Dickinson Wright PLLC; Andrew D. Dorisio

(57) ABSTRACT

A ventilated toilet for removing odors from the toilet base includes a unitary molded tank assembly with an integral ventilation cavity formed along the base and the back inside of the water tank. At least one water channel connects a water inlet chamber of the base to the water tank and is configured to channel water into the base when released from the tank, as well as to provide an airflow conduit for odors present in the base to be removed from the base via the ventilation cavity. A flush valve extends through the ventilation cavity to connect the tank and the base, and is sealed in attachment to eliminate egress of odors. The system permits substantial elimination of odors at flush volumes of 1.6, 1.3 or 0.8 gallons per flush by virtue of the enhanced seals and unitary construction. A toilet water tank assembly in accordance with the invention is also disclosed.

9 Claims, 4 Drawing Sheets

VENTILATED TOILET

This application is a continuation in part of U.S. application Ser. No. 17/503,669, filed on Oct. 18, 2021, which is a continuation in part of U.S. application Ser. No. 16/381,782 filed on Apr. 11, 2019, which claimed benefit of U.S. Provisional Application No. 62/656,547, the disclosures of which are incorporated herein by reference.

FIELD OF THE INVENTION

Embodiments of the present invention generally relate to toilets and more particularly toilets that are ventilated to remove odors outside of the atmospheric area in which the toilet is located.

BACKGROUND

The tendency in recent years towards closed rooms with air conditioning has changed the location of bathrooms, particularly in apartments, town houses, motels and hotels. Typically, in the past, bathrooms were often placed on an outside wall for ventilation to be obtained by means of a window. Recent designs to buildings places bathrooms within an interior of a building or living space in order to permit other living areas to be placed adjacent an exterior wall of the building or house, thus increasing the desirability of the living space. For those bathrooms placed within an interior space of a building or a living space, ventilation of odors from the bathroom is most often achieved by ceiling ventilation systems. That is, a ceiling vent sucks out air from the bathroom, through a conduit, and vents or exhausts bathroom air into the atmosphere. Accordingly, there is an increasing need for improved ventilation of the modern bathroom over the inefficient conventional method of ceiling vents.

Various types of devices for ventilating toilet bowls have been proposed and can be categorized into several groups according to their construction and mode of operation. A number of devices exist where the ventilation system is attached to the seat, is a part of the seat, or is built into the seat itself. These include U.S. Pat. No. 4,620,329, which discloses a toilet having an internal channel in the seat for the conveyance of air through hollow hinge mechanisms; and U.S. Pat. No. 4,094,023, which discloses a toilet seat having a perforated suction tube attached on the underside and an exhaust tube running down that extends into the bowl. These ventilation systems can cause a sanitary problem due to the presence of baffles, channels and openings along the underside of the seat and/or tubing located in the bowl which present a breeding ground for bacteria. Other devices exist in which a ventilation system is formed in the toilet bowl independent of the water tank. These require reconstruction of the bowl itself as in U.S. Pat. Nos. 3,938,201 and 4,222,129. Once again unsanitary conditions are present.

There are other ventilating devices where the ventilation is achieved through the overflow pipe, such as is exhibited in U.S. Pat. Nos. 4,232,406, 4,165,544 and 3,495,282. These inventions all suffer from insufficient airflow volume to adequately ventilate the toilet. In general, the above ventilation systems suffer from one or more of inadequate sanitation, unsightly appearance, physical obstruction, electrical shock hazard, lack of plumbing code compliance and/or expense.

One specific earlier reference of interest which the Applicant wishes to address from the perspective of its technical distinction and shortcomings over what is intended by the present invention is U.S. Pat. No. 4,989,276 (Martens). The components of the Martens device include nonintegrated or separately fitted cavity partition components, which by virtue of their separately fitted or nonintegrated or non-unitary nature with the remainder of the tank assembly will allow the movement and egress of odours from inside the tank. It is believed that if it were possible to negative this odor egress path this will provide a significant enhancement over the current state of the art.

US2013/0086736 (Larouche) is another reference of general interest in the field. That reference however discloses a system that permits the exhausting of odours from inside the water containment area of the toilet tank into the atmospheric area around the toilet. This occurs by positioning a powered exhaust intake above the surface of the water held within the tank. Allowing odours to enter the water storage area of the tank in the Larouche invention, above the water and below the tank lid, creates the possibility of not the probability for the egress of odours from the toilet water tank into the room or enclosure where the toilet is located. This is a significant limitation to this reference which it would be commercially desirable to overcome.

Another limitation of prior art in the field is the restricted or nonexistent ability of the prior art devices to work in all low and high volume flush applications. Lower volume flush applications have become more popular in more recent years to conserve water in sanitary applications and the lower water volumes are not capable of optimally actuating many of the prior art devices disclosed that discussed above. If it were possible to create a tank system for use of the toilet which maximize order egress and permitted usability optimization in all manner of lower and higher volume flushing applications the tank could also be used in retrofit as well as OEM applications and would enjoy further commercial application.

SUMMARY OF THE INVENTION

An objective of this invention is to provide a practical, durable, simple, inexpensive, and sanitary system of eliminating unwanted odors from the bathroom in an energy-efficient manner that can be adapted to work with toilets already installed in buildings.

The invention discloses an improved ventilated toilet for location within an enclosure and permits egress of odors from within the toilet to the atmosphere outside of the enclosure. The toilet includes a unitary molded water tank produced through molding and assembly practices as a finished one piece article—molded in a single shot and having a seamless monolithic tank structure which by virtue of its monolithic nature removes any fluid pathways for odor egress from the tank other than through intended seals or joints. The seamless monolithic tank structure disclosed, singly and in combination with the seals and the remainder of the toilet system, is a primary distinguishing and patentable aspect of the present invention over all of the prior art in the field.

The water tank includes a tank discharge opening through a bottom of the tank and a ventilation discharge opening extending through a rear wall of the tank above the bottom of the tank, for connection to a ventilation conduit. A water inlet is disposed above the tank discharge opening. The tank defines a unitary fluid chamber for containing a volume of water that can be released by a user through the tank discharge opening. Inside of the tank is also formed an integral ventilation cavity defined by a molded cavity partition of at least partial tank width, said ventilation cavity extending from the tank discharge opening to the ventilation discharge opening.

The tank has a downward-facing attachment face of the tank in the bottom thereof for engaging a toilet base.

Also included in the toilet of the invention is a base comprising a water inlet chamber and having an upward-facing attachment face of the base for connection to the corresponding attachment face of the tank to retain the two components in relation to each other. At least one water channel is formed in the based to connect the water inlet chamber to the water tank and configured to channel water into the base when released from the tank, as well as to provide an airflow conduit for odors present in the base to be removed from the base via the ventilation cavity. The base also includes a sewer-connected bowl capable of flushing upon actuation of the toilet.

A flush valve moveable between a closed position and an open position comprises a tubular connector body of sufficient length to define a fluid pathway connecting the discharge opening to the at least one water channel of the base, extending from a valve intake at an intake end of the tubular connector body positioned at the upper surface of the molded cavity partition to a valve discharge at the bottom outer surface of the tank, and comprising a plurality of enlarged vents extending therethrough along the section disposed within the ventilation cavity creating an atmospheric airflow pathway permitting airflow from the at least one water channel of the base through the connector body into the ventilation cavity in the absence of water. A valve intake at the intake end of the tubular connector body is mounted in sealed attachment to the surface of the molded cavity partition and is capable of permitting ingress of water from the fluid chamber into and through the tubular connector body when the valve is in the open position. A discharge opening at the discharge end of the tubular connector body is mounted in sealed attachment to an attachment face on the outer surface of the bottom of the tank.

The valve also comprises an actuator being a trip lever or other manual actuator connected to the valve intake and configured to move the flush valve from the closed position to the open position.

The sealed attachment of the valve intake and the discharge ends of the flush valve to the tank restrict any odors from escaping either seal into the enclosure. Upon connection of the ventilation discharge opening to the ventilation conduit and connection of the toilet to standard water and sewer service:

- on moving the actuator from the closed position to the open position the volume of water contained within the tank will be discharged into the toilet bowl, resulting in a toilet flush; and
- at any time other than during flushing, odors within the base can be actively or passively discharged to the atmosphere outside of the enclosure by movement of said odors through the at least one water channel to the discharge end of the ventilation conduit.

In many embodiments the valve intake comprises a flapper valve moveable from the closed position to the open position by the actuator, and wherein the flapper valve returns to the closed position in response to gravity as the water in the fluid chamber is released into the water inlet chamber.

The discharge opening of the valve can also further comprise a gasket operative to seal the connector body to the base.

The tank is connectable to a ventilation conduit to permit evacuation of odors from the enclosure in which the toilet is placed. In some embodiments the ventilation conduit further comprises a fan operative to draw odors from the base through the ventilation conduit and to expel the odors outside the enclosure.

The volume of the fluid chamber permits the discharge of any of 1.6, 1.3 or 0.8 gallons per flush of the toilet at which flush volume and flow rate odors are substantially removed from the base. The ability of the system of the present invention, by virtue of its complete sealing from the monolithic nature of the tank in combination with the seal to the base etc. and the enlarged vents, to completely negate the ability of odours to escape the tank system into the environment containing the toilet, at varying lower or higher volume flush volume and flow rates, represents a substantial enhancement and improvement over the operability of prior art devices all of which are designed and would only operate at higher volume flush volume and flow rates.

The invention also discloses a unitary molded toilet water tank assembly for use in conjunction with a toilet base comprising a water inlet chamber, an upward-facing attachment face of the base for connection to the corresponding attachment face of the tank to retain the two components in relation to each other, at least one water channel connecting the water inlet chamber to the water tank and configured to channel water into the base when released from the tank, as well as to provide an airflow conduit for odors present in the base to be removed from the base via the ventilation cavity, and a sewer-connected bowl capable of flushing upon actuation of the toilet.

The water tank assembly comprises a unitary molded water tank produced through molding and assembly practices as a finished one piece article—molded in a single shot and having a seamless monolithic tank structure which by virtue of its monolithic nature removes any fluid pathways for odor egress from the tank other than through intended seals or joints. The seamless monolithic tank structure disclosed, singly and in combination with the seals and the remainder of the toilet system, is a primary distinguishing and patentable aspect of the present invention over all of the prior art in the field. The tank includes a tank discharge opening through a bottom of the tank and a ventilation discharge opening extending through a rear wall of the tank above the bottom of the tank, for connection to a ventilation conduit. A water inlet is disposed above the tank discharge opening. The tank defines a unitary fluid chamber for containing a volume of water that can be released by a user through the tank discharge opening. Inside of the tank is also formed an integral ventilation cavity defined by a molded cavity partition of at least partial tank width, said ventilation cavity extending from the tank discharge opening to the ventilation discharge opening. The tank has a downward-facing attachment face of the tank in the bottom thereof for engaging a toilet base.

A flush valve moveable between a closed position and an open position comprises a tubular connector body of sufficient length to define a fluid pathway connecting the discharge opening to the at least one water channel of the base, extending from a valve intake at an intake end of the tubular connector body positioned at the upper surface of the molded cavity partition to a valve discharge at the bottom outer surface of the tank, and comprising a plurality of enlarged vents extending therethrough along the section disposed within the ventilation cavity creating an atmospheric airflow pathway permitting airflow from the at least one water channel of the base through the connector body into the ventilation cavity in the absence of water. A valve intake at the intake end of the tubular connector body is mounted in sealed attachment to the surface of the molded cavity partition and is capable of permitting ingress of water from the fluid chamber into and through the tubular connector body when the valve is in the open position. A discharge opening at the discharge end of the tubular connector body is mounted in sealed attachment to an attachment face on the outer surface of the bottom of the tank.

The valve also comprises an actuator being a trip lever or other manual actuator connected to the valve intake and configured to move the flush valve from the closed position to the open position.

The volume of the fluid chamber permits the discharge of any of 1.6, 1.3 or 0.8 gallons per flush of the toilet at which flush volume and flow rate odors are substantially removed from the base. The ability of the system of the present invention, by virtue of its complete sealing from the monolithic nature of the tank in combination with the seal to the base etc. along with the enlarged vents, to completely negate the ability of odours to escape the tank system into the environment containing the toilet, at varying lower or higher volume flush volume and flow rates, represents a substantial enhancement and improvement over the operability of prior art devices all of which are designed and would only operate at higher volume flush volume and flow rates.

BRIEF DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numerals, and where:

DETAILED DESCRIPTION OF THE INVENTION

Figure 1:
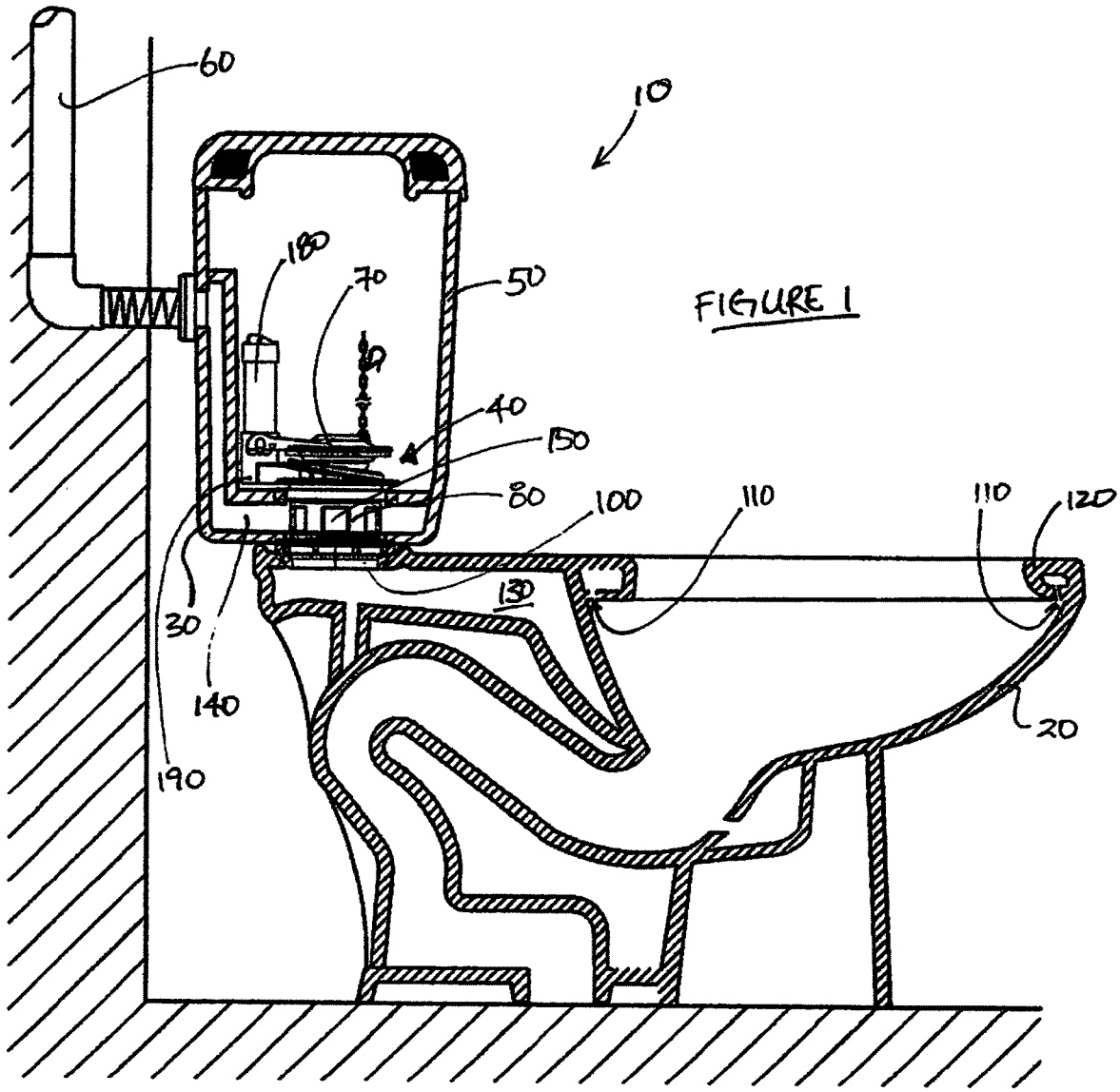
FIG. 1 is a side cross-sectional view of an embodiment of the present invention illustrating a siphon base, a integral ventilation conduit, a water tank, connector body, and a flapper valve.

With reference to FIG. 1, an embodiment of the present invention comprises a ventilated toilet base comprising a toilet base 20, a integral ventilation conduit 30, and flush valve 40 for sealingly and fluidly connecting a water tank 50 to the toilet base 20.

It is specifically contemplated that the water tank 50 of the present invention will be a unitary water tank 50, moulded or otherwise manufactured in a single seamless monolithic body which removes any seams or joints through which flush behaviour within the tank system could be negatively impacted during flushing, or providing any egress pathways in jointed adjacency of non-unitary components. Given the number of toilet tank and base manufacturers who manufacture in porcelain or other ceramics, one of the primary complexities of the present invention will be the ability to create ceramic moulds or fitments which can be used to properly cast a monolithic and unitary tank body. The seamless monolithic tank body is what is intended by the description as a "unitary" body in the remainder of the application. The seamless monolithic water tank body in conjunction with the seals described elsewhere in the claims and specification provide the significantly enhanced odor removal activity of the present invention over the prior art.

The tank 50 defines a unitary fluid chamber for containing a volume of water that can be released by a user through the tank discharge opening. Inside of the tank is also formed an integral ventilation cavity defined by a molded cavity partition of at least partial tank width, said ventilation cavity extending from the tank discharge opening to the ventilation discharge opening. The unitary construction of the tank via various molding and forming techniques to yield a completed unitary tank 50 will be understood to those skilled in the art of such manufacture—the unitary nature of the tank 50 results in an enhanced sealing ability of the tank 50 to the toilet base 20, along with simplifying the finished toilet since there are fewer parts to repair or install.

The bottom surface of the tank 50 forms a downward-facing attachment face of the tank 50 for engaging a toilet base 20. Similarly the upward-facing upper surface of the toilet base 20 provides an upward-facing attachment face for engagement and support of the tank 50 when the two components are joined.

The toilet base 20 can be secured to a floor using known techniques, such as a base flange (not shown).

To ensure that the water tank 50, the integral ventilation conduit 30 and the toilet base 20 are all fluidly sealed together, flush valve 40 is used. In one embodiment, and as shown in FIG. 1, the flush valve 40 can comprise a valve intake 70 operatively connected to a tubular connector body 80 having enlarged vent channels 150, and a discharge opening for permitting the flushing of water from the tank 50 into the toilet base 20. The valve intake 70 as shown is a flapper valve.

As shown, the valve intake 70 is positioned within the water tank 50 and is operatively connected to the connector body 80 which spans the width of the integral ventilation conduit 30 to extend into the toilet base 20. The tubular connector body 80 is of sufficient length to define a fluid pathway connecting the discharge opening thereof to the at least one water channel of the base, extending from the valve intake 70 at an intake end of the tubular connector body positioned at the upper surface of the molded cavity partition to a valve discharge at the bottom outer surface of the tank, and comprising a plurality of enlarged vents 150 extending therethrough along the section disposed within the integral ventilation conduit 30 creating an atmospheric airflow pathway permitting airflow from the at least one water channel of the toilet base 20 through the connector body 80 into the integral ventilation conduit 30 in the absence of water.

A rubber gasket 100 can be used to secure and seal the connector body 80 to the toilet base 20, and fluidly connect the toilet base 20 to the vent channel 30 and the water tank 50.

The toilet base 20 further comprises at least one water channel 110, which in some embodiments can be located along an underside of the top circumferential ring 120 of the toilet base 20. In action, the flushing of the toilet typically causes water from the water tank 50 to flow through the flush valve 40 and into a water inlet chamber 130 and into the toilet base 20 through the water channels 110.

The water channels 110 can also serve to function as vent apertures for odors within the toilet base to be exhausted through the water inlet chamber 130. As the odors collect within the water inlet chamber 130, the odors pass through into the connector body 80 of the flush valve 40 and are directed into the integral ventilation conduit 30 through enlarged vents 150.

The enlarged vents 150, are effective to permit operation of the system both with older versions of toilet installations, as well as with low flow and High Efficiency Toilet (HET) configurations that are designed to operate with reduced water volume per flush. For example, embodiments of the present system are effective to remove odors in toilet systems with flows of 1.6 gallons per flush (GPF), or lower. In some embodiments, the system is effective to remove odors in toilet installations with flows of about 1.3 GPF or lower. In some embodiments, the system is effective to remove odors in toilet installations with flows of 0.8 GPF or lower. The ability of the system of the present invention, by virtue of its complete sealing from the monolithic nature of the tank in combination with the seal to the base etc. and the enlarged vents 150, to completely negate the ability of odours to escape the tank system into the environment containing the toilet, at varying lower or higher volume flush volume and flow rates, represents a substantial enhancement and improvement over the operability of prior art devices all of which are designed and would only operate at higher volume flush volume and flow rates. The enlarged vents 150 are key in terms of the invention and this ability to provide odor egress behaviour on toilets of this nature with varying flush volumes since the enlarged vents provide enhanced odor pathways and air volume at appropriate operation moments of the toilet. The ability to retrofit an existing toilet with a tank system of the nature disclosed, for use in newer lower flush volume applications, will be immediately understood by those skilled in the art to be a significant commercial benefit to the present invention over any of the identified art. The enlarged vents 150 will, in comparison to prior art devices, permit the necessary flushing volume 4 higher or lower water volumes in the water tank of the toilet as well as odor or air volumes being evacuated therefrom, within the defined flushing window for the toilet in question.

Figure 2:
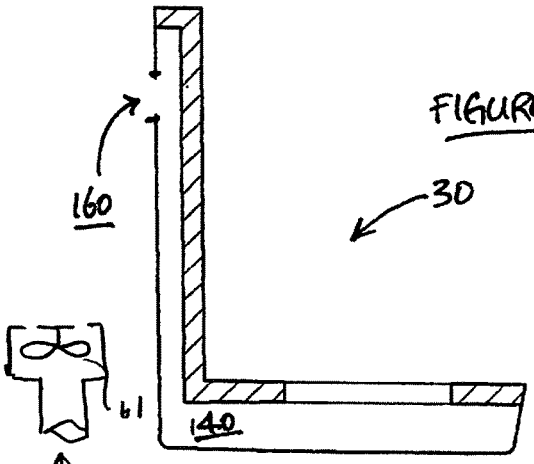
FIG. 2 is an enlarged side cross-sectional view of the integral ventilation conduit of FIG. 1.

With reference to FIG. 2, the integral ventilation conduit 30 has a ventilation discharge opening 160 adjacent a top portion thereof which can be adapted to fluidly connect the integral ventilation conduit 30 to a pre-existing ventilation conduit 60. The ventilation conduit 60 can be fluidly connected to the outside atmosphere using known techniques and also include a fan 61 to encourage and/or ensure consistent ventilation of odors from the toilet 10 and their movement to the atmosphere outside the enclosure where the toilet is situated.

Figure 3A:
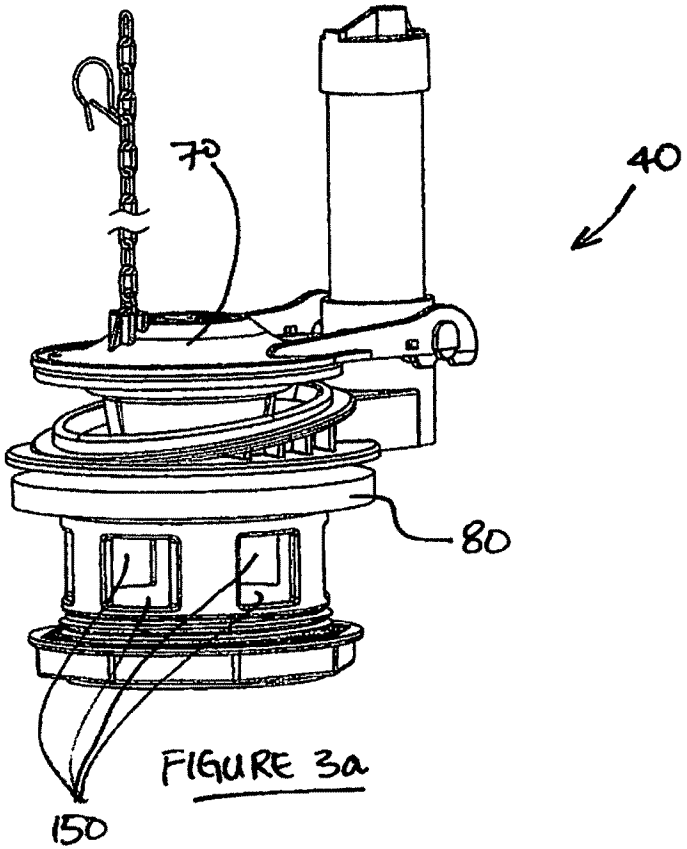
FIG. 3*a* is an enlarged side perspective view of the flapper valve and the connector body of FIG. 1.
Figure 3B:
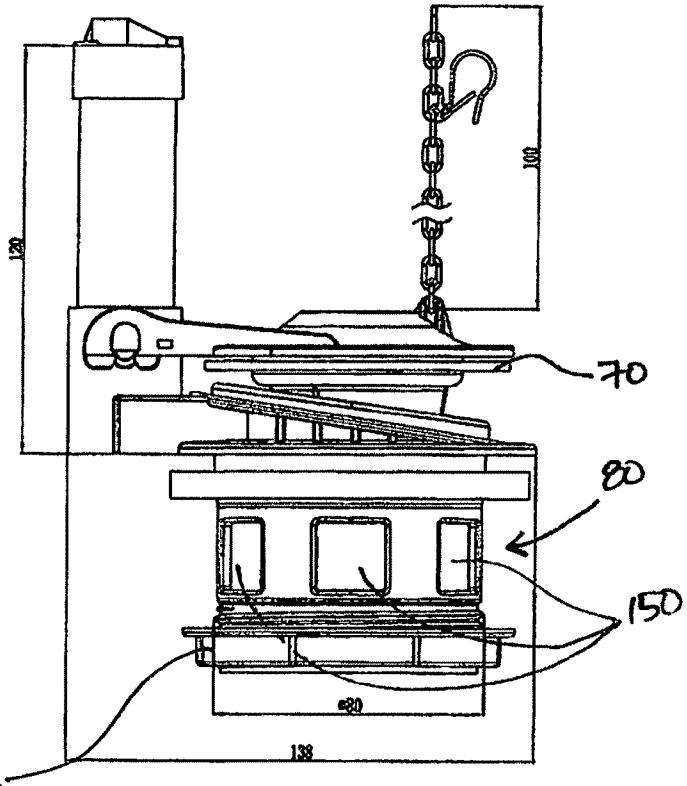
FIG. 3*b* is side view of the flapper valve and the connector body of FIG. 3*a;*
Figure 3C:
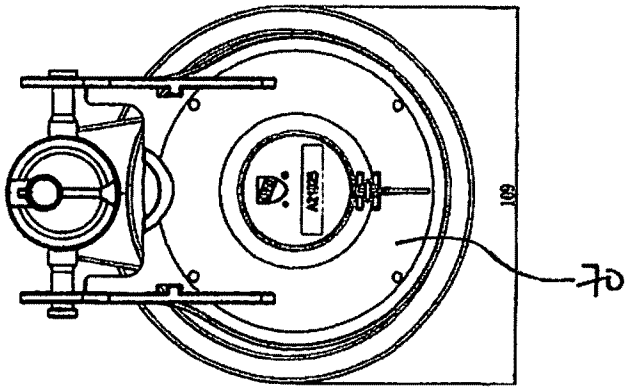
FIG. 3*c* is a plan view of the flapper valve and the connector body of FIG. 3*a;*

FIGS. 3*a* to 3*c* illustrate the flush valve 40 in greater detail. As shown, the valve intake 70 is adapted to be sealably secured to a bottom portion of the water tank 50 by threaded connection to the connector body 80, which extends the width of the vent channel 30. As shown the enlarged vents 150 of the connector body 80 are aligned within the ventilation cavity 140 of the integral ventilation conduit 30. As shown, a bottom portion of the connector body 80 extends beyond the integral ventilation conduit 30 and is positioned within the water inlet channel 130 and secured thereto by a rubber gasket 100.

Figure 4A:
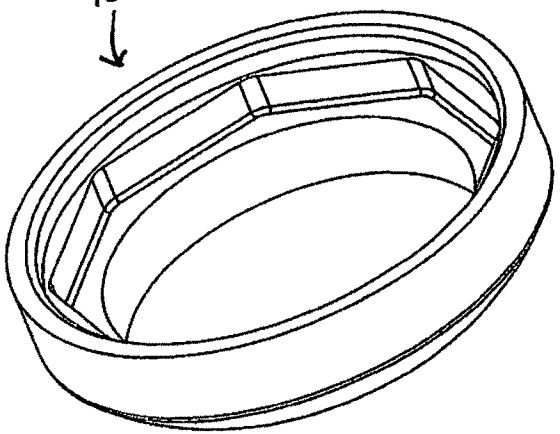
FIG. 4*a* is an enlarged side perspective view of an embodiment of the present invention illustrating a rubber gasket for sealing the integral ventilation conduit to the toilet base and water tank of FIG. 1.
Figure 4B:
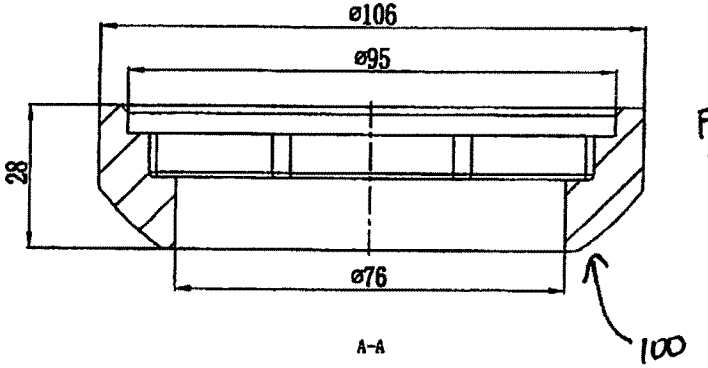
FIG. 4*b* is a side cross-sectional view of the rubber gasket of FIG. 4*a;*
Figure 4C:
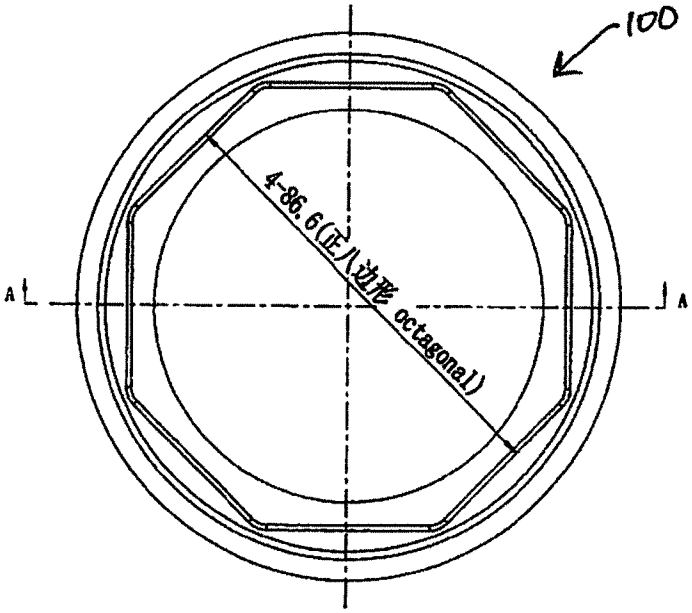
FIG. 4*c* is a plan view of the rubber gasket of FIG. 4*a;*
Figure 5D:
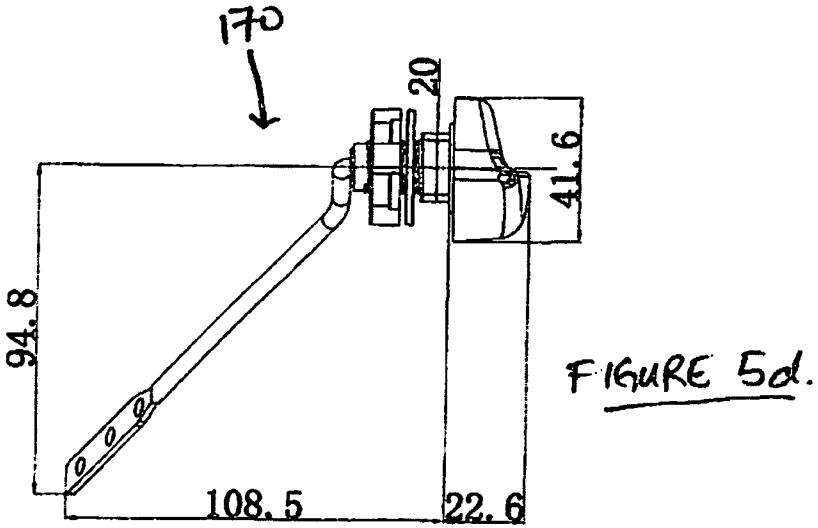
FIG. 5*d* is a rear view of the trip lever of FIG. 5*a.*
Figure 5A:
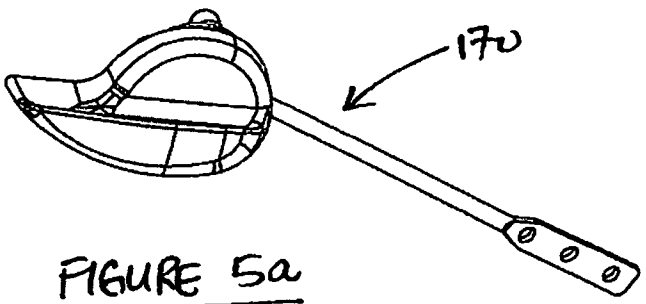
FIG. 5*a* is a side perspective view of an embodiment of the present invention illustrating a trip lever for use with the flapper valve of FIG. 1.
Figure 5B:
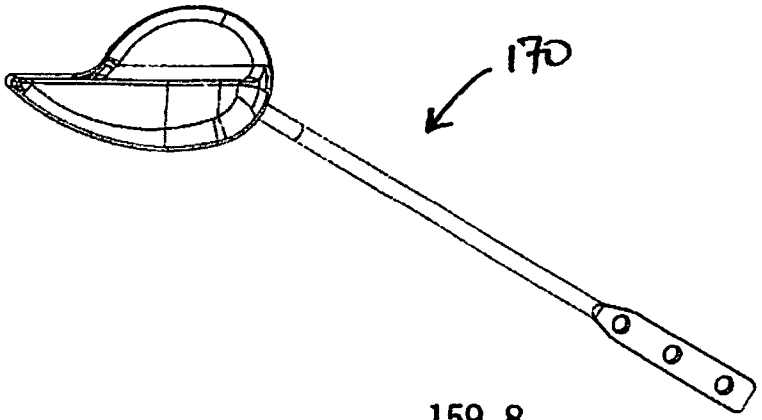
FIG. 5*b* is a side view of the trip lever of FIG. 5*a;*
Figure 5C:
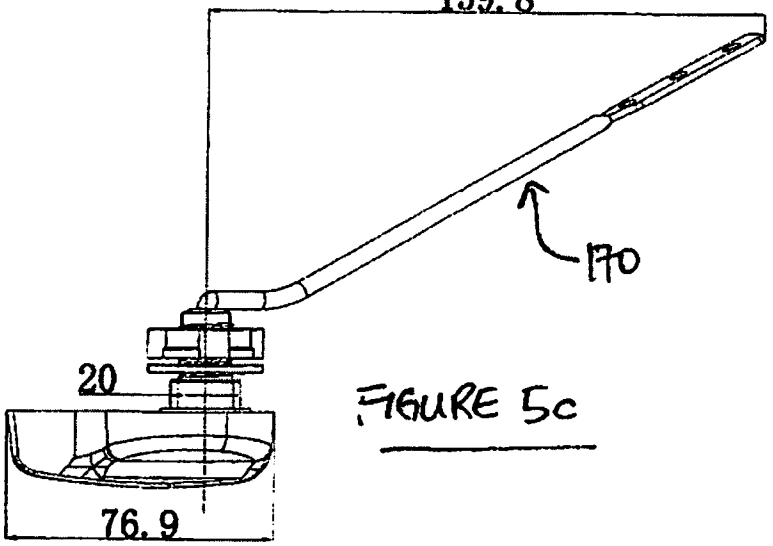
FIG. 5*c* is a plan view of the trip lever of FIG. 5*a*.

Embodiments of the rubber gasket 100 are shown in FIGS. 4*a* to 4*c*.

FIGS. 5*a* to 5*d*, inclusive, illustrate an embodiment of an actuator being a trip lever 170 that can be adapted to be used with any pre-existing water tank. Referring back to FIG. 1, the trip lever 170 is operatively connected to a fill valve 180 that is fluidly connected to a water intake 190 along a bottom surface of the water tank 50 and operatively connected to the valve intake 70. By pushing down on the trip lever 170, the valve intake 70 is caused to be opened, allowing the water stored within the water tank 50 to escape through the flush valve 40 and into the toilet base 20.

When the toilet is not being flushed, any odors within the toilet base 20 pass through the water channels 110, into the water inlet chamber 130, through the enlarged vents 150 and into the ventilated cavity 140/integral ventilation conduit 30. From there a fan 61 can evacuate the odors to be fluidly moved through the ventilation conduit 60 and into the outside atmosphere.

In some embodiments, the fan can be configured to run continuously. In other cases, it may be desirable to activate the fan only when the ventilated toilet is in use, and possibly for a period of time afterwards. In this case the apparatus could include a switching mechanism to allow a user to turn the fan on and off as desired. In still other embodiments, operation of the fan may be link to the actuator assembly, such that when the toilet is flushed the fan is automatically started. In these cases, the system might also include a timer to turn the fan off again after a pre-determined length of time.

In addition to the toilet disclosed, other embodiments of the invention include a toilet tank assembly comprising the tank 50 and the flush valve 40, or also the tank 50 itself as disclosed for use in toilet configurations as discussed.

It will be recognized that the specific materials used in constructing the various components of the system described herein are not considered to be limiting to the scope of the invention. Those of skill in the art will readily recognize and, be able to, select materials and components that will accomplish the objectives of the invention without requiring any inventive skill. It should also be apparent to those skilled in the art that many more modifications besides those already described are possible without departing from the inventive concepts herein.

Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Any reference or depiction of dimensions or relationships of the sizes of components of the system described herein are merely for illustrative purposes and are not to be construed as limiting in any way to the scope of the invention.

The invention claimed is:

1. A ventilated toilet for location within an enclosure and permitting egress of odors from within the toilet to the atmosphere outside of the enclosure while negating odor discharge from the toilet within the enclosure, said toilet comprising:

a. a unitary molded water tank which is molded in a single shot and has a seamless monolithic tank structure, said water tank comprising:

i. a tank discharge opening through a bottom of the tank;

ii. a ventilation discharge opening extending through a rear wall of the tank above the bottom of the tank, for connection to a ventilation conduit;

iii. a water inlet disposed above the tank discharge opening;

iv. a unitary fluid chamber for containing a volume of water that can be released by a user through the tank discharge opening;

v. an integral ventilation cavity defined by a molded cavity partition of at least partial tank width, said ventilation cavity extending from the tank discharge opening to the ventilation discharge opening; and vi. a downward-facing attachment face of the tank in the bottom thereof for engaging a base;

b. the base comprising:

i. a water inlet chamber;

ii. an upward-facing attachment face of the base for connection to the corresponding attachment face of the tank to retain the two components in relation to each other;

iii. at least one water channel connecting the water inlet chamber to the water tank and configured to channel water into the base when released from the tank, as well as to provide an airflow conduit for odors present in the base to be removed from the base via the ventilation cavity; and iv. a sewer-connected bowl capable of flushing upon actuation of the toilet;

c. a flush valve moveable between a closed position and an open position, said flush valve comprising:

i. a tubular connector body of sufficient length to define a fluid pathway connecting the discharge opening to the at least one water channel of the base, extending from a valve intake at an intake end of the tubular connector body positioned at the upper surface of the molded cavity partition to a valve discharge at the bottom outer surface of the tank, and comprising a plurality of enlarged vents extending therethrough along the section disposed within the ventilation cavity creating an atmospheric airflow pathway permitting airflow from the at least one water channel of the base through the connector body into the ventilation cavity in the absence of water;

ii. a valve intake at the intake end of the tubular connector body mounted in sealed attachment to the surface of the molded cavity partition, said valve intake capable of permitting ingress of water from the fluid chamber into and through the tubular connector body when the valve is in the open position;

iii. a discharge opening at the discharge end of the tubular connector body mounted in sealed attachment to an attachment face on the outer surface of the bottom of the tank; and iv. an actuator comprising a trip lever connected to the valve intake and configured to move the flush valve from the closed position to the open position;

wherein the sealed attachment of the valve intake and the discharge ends of the flush valve to the tank restrict any odors from escaping either seal into the enclosure;

wherein the enlarged vents permit the operation of the toilet at varying higher or lower water flushing volumes from the water tank; and wherein upon connection of the ventilation discharge opening to the ventilation conduit and connection of the toilet to standard water and sewer service:

on moving the actuator from the closed position to the open position the volume of water contained within the tank will be discharged into the toilet bowl, resulting in a toilet flush;

at any time other than during flushing, odors within the base are actively or passively discharged to the atmosphere outside of the enclosure by movement of said odors through the at least one water channel to the discharge end of the ventilation conduit; and the seamless monolithic nature of the tank structure negates the ability for odors to escape the tank via any seam or opening other than the ventilation discharge opening.

2. The ventilated toilet of claim 1 wherein the valve intake comprises a flapper valve moveable from the closed position to the open position by the actuator, and wherein the flapper valve returns to the closed position in response to gravity as the water in the fluid chamber is released into the water inlet chamber.

3. The ventilated toilet of claim 1 wherein the discharge opening of the valve further comprises a gasket operative to seal the connector body to the base.

4. The ventilated toilet of claim 1 wherein the ventilation conduit further comprises a fan operative to draw odors from the base through the ventilation conduit and to expel the odors outside the enclosure.

5. The ventilated toilet of claim 1 wherein the combined behaviour of the volume of the fluid chamber and the enlarged vents permits the discharge of any of 1.6, 1.3 or 0.8 gallons per flush of the toilet at which flush volume and flow rate odors are substantially removed from the base.

6. A toilet water tank assembly for use in conjunction with a toilet base comprising:

a. a water inlet chamber;

b. an upward-facing attachment face of the base for connection to the corresponding attachment face of the tank to retain the two components in relation to each other;

c. at least one water channel connecting the water inlet chamber to the water tank and configured to channel water into the base when released from the tank, as well as to provide an airflow conduit for odors present in the base to be removed from the base via an integral ventilation cavity; and d. a sewer-connected bowl capable of flushing upon actuation of the toilet;

said water tank assembly comprising:

a. a unitary molded water tank molded in a single shot and having a seamless monolithic tank structure and comprising:

a. a tank discharge opening through a bottom of the tank;

b. a ventilation discharge opening extending through a rear wall of the tank above the bottom of the tank, for connection to a ventilation conduit;

c. a water inlet disposed above the tank discharge opening;

d. a unitary fluid chamber for containing a volume of water that can be released by a user through the tank discharge opening;

e. the ventilation cavity defined by a molded cavity partition of at least partial tank width, said ventilation cavity extending from the tank discharge opening to the ventilation discharge opening; and f. a downward-facing attachment face of the tank in the bottom thereof for engaging the base; and b. a flush valve moveable between a closed position and an open position, said flush valve comprising:

a. a tubular connector body of sufficient length to define a fluid pathway connecting the discharge opening to the at least one water channel of the base, extending from a valve intake at an intake end of the tubular connector body positioned at the upper surface of the molded cavity partition to a valve discharge at the bottom outer surface of the tank, and comprising a plurality of enlarged vents extending therethrough along the section disposed within the ventilation cavity creating an atmospheric airflow pathway permitting airflow from the at least one water channel of the base through the connector body into the ventilation cavity in the absence of water;

i. a valve intake at the intake end of the tubular connector body mounted in sealed attachment to the surface of the molded cavity partition, said valve intake capable of permitting ingress of water from the fluid chamber into and through the tubular connector body when the valve is in the open position;

ii. a discharge opening at the discharge end of the tubular connector body mounted in sealed attachment to an attachment face on the outer surface of the bottom of the tank; and iii. an actuator comprising a trip lever connected to the valve intake and configured to move the flush valve from the closed position to the open position;

wherein:

the attachment face of the tank can be attached to the corresponding attachment face of the base to retain the tank assembly and base in relation to each other;

the enlarged vents permit the operation of the toilet at varying higher or lower water flushing volumes from the water tank; and the sealed attachment of the valve intake and the discharge ends of the flush valve to the tank restrict any odors from escaping either seal; and the seamless monolithic nature of the tank structure negates the ability for odors to escape the tank via any seam or opening other than the ventilation discharge opening.

7. The toilet water tank assembly of claim 6 wherein the discharge opening of the valve further comprises a gasket operative to seal the connector body to the base.

8. The toilet water tank assembly of claim 6 wherein the combined behaviour of the volume of the fluid chamber and the enlarged vents permits the discharge of any of 1.6, 1.3 or 0.8 gallons per flush of the toilet at which flush volume and flow rate odors are substantially removed from the base.

9. A unitary molded toilet water tank for use in conjunction with a toilet base, said water tank molded in a single shot and having a seamless monolithic tank structure and comprising:

a. a tank discharge opening through a bottom of the tank;

b. a ventilation discharge opening extending through a rear wall of the tank above the bottom of the tank, for connection to a ventilation conduit;

c. a water inlet disposed above the tank discharge opening;

d. a unitary fluid chamber for containing a volume of water that can be released by a user through the tank discharge opening;

e. an integral ventilation cavity defined by a molded cavity partition of at least partial tank width, said ventilation cavity extending from the tank discharge opening to the ventilation discharge opening; and f. a downward-facing attachment face of the tank in the bottom thereof for engaging the base;

wherein said tank can be used in conjunction with a flush valve moveable between a closed position and an open position, said flush valve comprising:

i. a tubular connector body of sufficient length to define a fluid pathway connecting the discharge opening to the at least one water channel of the base, extending from a valve intake at an intake end of the tubular connector body positioned at the upper surface of the molded cavity partition to a valve discharge at the bottom outer surface of the tank, and comprising a plurality of enlarged vents extending therethrough along the section disposed within the ventilation cavity creating an atmospheric airflow pathway permitting airflow from the at least one water channel of the base through the connector body into the ventilation cavity in the absence of water;

ii. a valve intake at the intake end of the tubular connector body mounted in sealed attachment to the surface of the molded cavity partition, said valve intake capable of permitting ingress of water from the fluid chamber into and through the tubular connector body when the valve is in the open position;

iii. a discharge opening at the discharge end of the tubular connector body mounted in sealed attachment to an attachment face on the outer surface of the bottom of the tank; and iv. an actuator comprising a trip lever connected to the valve intake and configured to move the flush valve from the closed position to the open position;

wherein the attachment face of the tank attaches to a corresponding attachment face of a base to retain the tank assembly and base in relation to each other and the sealed attachment of the valve intake and the discharge ends of the flush valve to the tank restrict any odors from escaping either seal; and wherein the seamless monolithic nature of the tank structure negates the ability for odors to escape the tank via any seam or opening other than the ventilation discharge opening.

* * * * *